US005952054A

United States Patent [19]

Sato et al.

[11] Patent Number: 5,952,054

[45] Date of Patent: Sep. 14, 1999

[54] METHOD OF FORMING SPRAY DEPOSIT AND INTEGRATED SEALER LAYER

[75] Inventors: Takao Sato, Chita; Atsushi Migita; Kiyohiro Tarumi, both of Fukuoka, all of Japan

[73] Assignee: Nippon Steel Hardfacing Co., Ltd., Tokyo, Japan

[21] Appl. No.: 08/945,374

[22] PCT Filed: Feb. 27, 1997

[86] PCT No.: PCT/JP97/00568

§ 371 Date: Dec. 11, 1997

§ 102(e) Date: Dec. 11, 1997

[87] PCT Pub. No.: WO97/32053

PCT Pub. Date: Sep. 4, 1997

[30] Foreign Application Priority Data

Feb. 28, 1996 [JP] Japan ..... 8-065161

[51] Int. Cl.[6] ..... C23C 4/18

[52] U.S. Cl. ..... 427/449; 427/447; 427/454; 427/455

[58] Field of Search ..... 427/447, 449, 427/454, 455

[56] References Cited

FOREIGN PATENT DOCUMENTS

| | | | |
|---|---|---|---|
| 56-127449 | 10/1981 | Japan | 427/447 |
| 59-145776 | 8/1984 | Japan . | |
| 63-69959 | 3/1988 | Japan . | |
| 2-217458 | 8/1990 | Japan | 427/447 |
| 6-10112 | 1/1994 | Japan . | |
| 6-88198 | 3/1994 | Japan | 427/447 |

OTHER PUBLICATIONS

The Science and Engineering of Thermal Spray Coatings, Lech Pawlowski, John Wiley & Sons, pp. 64–66, 1995 (no month date).

Thermal Spraying! Practice, Theory, And Application, American Welding Society, p. 108, 1985 (no month date).

Brazing Technic and It's application, Masakatsu Umagome, Shikoku Kogyo Association, Takamatsu Japan 1989, pp. 9–15 (no month date).

Brazing Handbook by Japan Brazing Association, Tokyo, Japan, Oct. 25, 1994, pp. 388–398.

*Primary Examiner*—Katherine A. Bareford
*Attorney, Agent, or Firm*—Kanesaka & Takeuchi

[57] ABSTRACT

A spray deposit is formed by applying a spray deposit on a target object, and applying a sealer onto the spray deposit on the target object immediately after the spray deposit is applied on the target object. Thus, a thin layer of sealer components contained in the sealer is formed immediately on the spray deposit while a liquid component of the sealer volatilizes.

9 Claims, 4 Drawing Sheets

METHOD OF FORMING SPRAY DEPOSIT AND INTEGRATED SEALER LAYER

CROSS REFERENCE TO RELATED APPLICATION

This is a national stage application of PCT/JP97/00568, filed on Feb. 27, 1997.

TECHNICAL FIELD

The present invention relates to a spraying method, and in particular, relates to a method for forming fine spray deposits having superior adhesion capability.

BACKGROUND ART

Conventionally, when a sprayed deposit was subjected to sealing processing, processing was conducted in which, after the completion of spraying, a sealer was applied or sprayed onto the deposit, and where necessary, baking processing was conducted.

Accordingly, there were cases in which the sealing processing was insufficient, because the sealing did not sufficiently penetrate to the lower layer of the deposit or the like.

Furthermore, the present inventors have previously proposed interrupting spraying during the formation of a spray deposit and conducting sealing processing (Japanese Patent Application No. HEI 6-321207), however, with this method, there were problems with the removal of excess sealer, the oxidation of the spray deposit, and the like, and there were numerous cases in which a sufficiently fine spray deposit could not be obtained, and the corrosion resistance with respect to acidic and alkaline solutions was also insufficient.

The problems to be solved in the conventional technology described above are the ability to conduct sealing processing uniformly throughout the whole thickness of the sprayed deposit, so as to obtain a fine deposit. For example, this would involve the provision of a deposit having sufficient corrosion resistance with respect to acidic or alkaline chemicals, the provision of a spray deposit which is resistant to penetration by molten metals, the provision of a spray deposit as an anti-corrosion treatment for the base metal, and the like.

The present invention has as an object thereof to provide a spray deposit which will reliably allow the incorporation in the spray deposit of a material which is difficult to spray or a material which is easily oxidized and hence can not be sprayed, and will also allow the exploitation of the properties of this material.

This would involve, for example, the execution, on a paper making roller, of a spray deposit which facilitates removal of the paper, the provision of a spray deposit which is resistant to molten metal as a molten metal plating bath material, the provision of a spray deposit having particularly superior resistance to abrasion or the like.

The present invention solves the problems present in the conventional technology described above; it has as an object thereof to provide a fine spray deposit having excellent adhesion capabilities.

DISCLOSURE OF INVENTION

In order to attain the object described above, as a result of diligent research, the present inventors have discovered that conducting sealing processing parallel to at the same time of conducting spraying onto a target object is effective, and have thus arrived at the present invention.

The present invention, which was created based on the above discoveries, has as a feature thereof a method of forming spray deposits in which, during the formation of a spray deposit, while a spray is conducted with respect to a target object using a flame spraying machine, a sealer is sprayed or applied, and deposit making processing and sealing processing are conducted in a parallel manner.

Furthermore, the followings are also features of the present invention: the formation of a spray deposit using a gas spray mechanism, a plasma spray mechanism, or a wire metallizing mechanism; the fact that the spray material comprises a metal, a cermet, or ceramic; the fact that the sealer comprises a material producing an oxide such as $Cr_2O_3$, $Al_2O_3$, $SiO_2$, $ZrO_2$, or the like; and the fact that by means of conducting sealing processing using one or more of silicon compounds, boron compounds, fluorine compounds, nitrogen compounds, and carbon compounds as the sealer which is sprayed or applied during spraying, one or more of silicides, borides, fluorides, nitrides, and oxides are formed in the deposit.

Additionally, the following are also features of the present inventions spraying which does not also employ a sealer is conducted as a substrate, while in the upper layer thereof, a sealer is sprayed or applied while conducting spraying, so that deposit making processing and sealing processing are conducted in parallel; heat processing which improves the bonding strength of the deposit is conducted after the conclusion of all spraying; and after the formation of the spray deposit, finishing sealing processing, or sealing processing and heat processing, is again conducted.

Description of the References

| Description of the References | |
|---|---|
| 1 | roller body |
| 2 | spray nozzle |
| 3 | sealer application device |
| 5 | test paper |
| 6 | water receiving vessel |
| 7 | test material |
| 8 | application roller |
| 9 | grip roller |
| 10 | blotting paper |
| 11 | weight |
| 12 | small load cell |
| 13 | bar-shaped zinc |
| 14 | spray deposit |
| 15 | substrate |
| 16 | emery paper |
| 17 | spray deposit |
| 18 | test piece |
| 19 | sample |
| 20 | molten zinc bath |

-continued

| Description of the References | |
|---|---|
| 21 | furnace |
| 22 | upper lid |

Best Mode for Carrying Out the Invention

DETAILED DESCRIPTION OF PREFERRED EMBODIMENTS

The structure and function of the present invention will be explained based on the figures.

Figure 1:
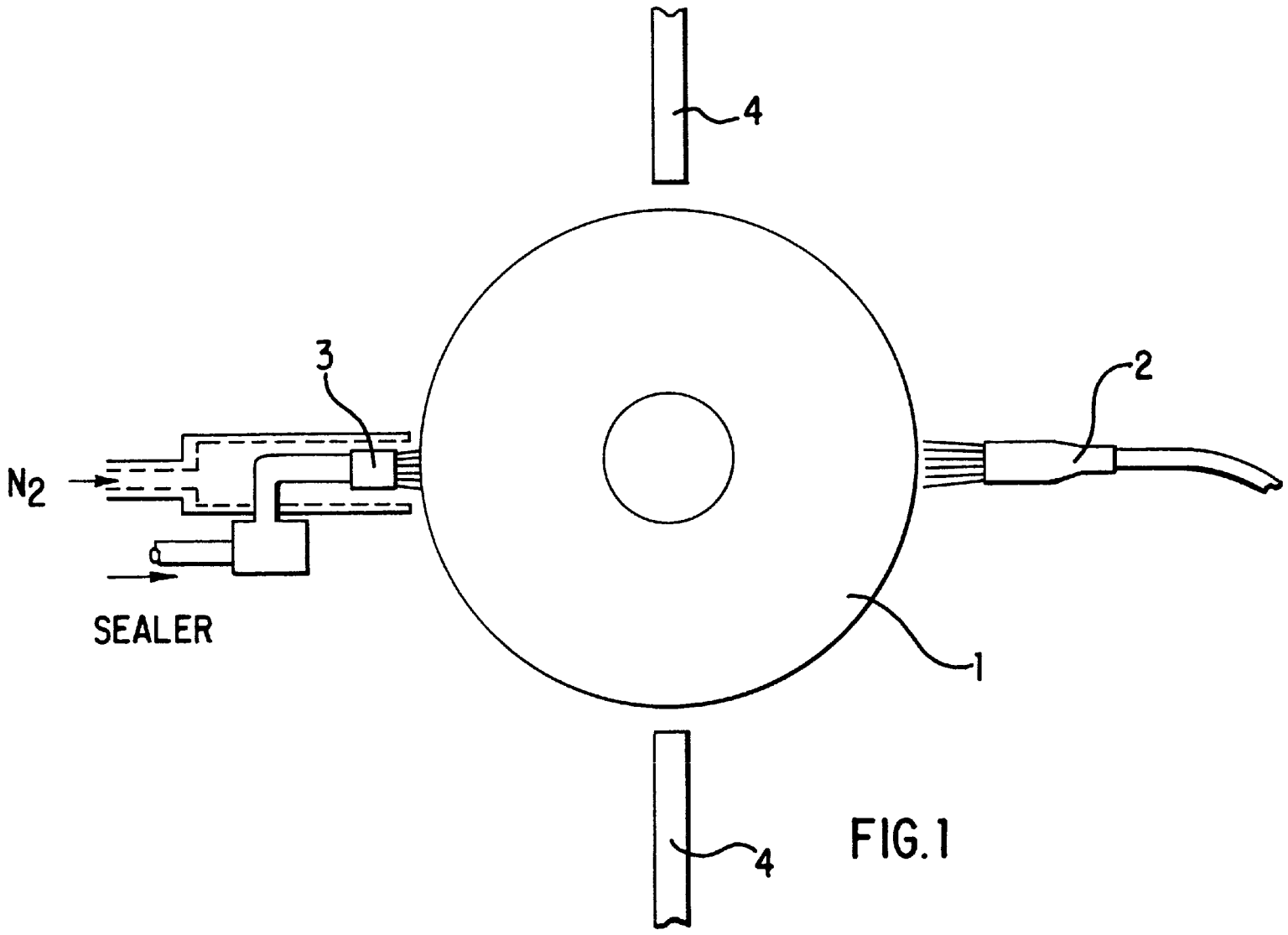
FIG. 1 is a schematic diagram of the case in which spray sealing processing in accordance with the present invention is applied to a base material which is in the form of a roller.

As a method for spraying sealer while conducting spraying using a flame spraying machine in accordance with the present invention, a spray nozzle 2 and sealer application device 3 are disposed symmetrically to the left and the right of a cylindrical target object 1 such as a roller or the like shown in FIG. 1, and while rotating the target object 1, sealer is sprayed or applied, and spraying is conducted onto this. Reference 4 indicates a partition.

While rotating roller 1, a spray deposit is continuously formed on roller 1 by spray nozzle 2, and on the side opposite to the spray nozzle, a sealer is continuously applied by application device 3 onto the hot spray deposit. As a result of the retained heat of the spray deposit, only the sealer liquid components volatilize and disperse, so that a thin layer of sealer components is formed, and a further spray deposit is formed on this layer by spray nozzle 2.

A gas spray, a plasma spray, or wire metallizing may be employed as the spray mechanism; when a gas spray is employed, a high speed gas spray method is desirable in order to obtain a fine deposit.

A metal, a cermet, or ceramics may be employed as the spray material; the present invention may use to any of these. The present invention is applicable to either of angled spraying and compound spraying.

The method of the present invention is also applicable to overlaying spraying, such as a substrate spray layer in which sealing processing is not conducted.

After the completion of spraying, if baking processing is conducted, the bonding strength of the spray deposit will be increased. Furthermore, finishing sealing processing and heat processing may be combined.

Various substances may be used as the sealing material. It is possible to use so called sol-gel type metal alkoxide-alcohol type materials as the oxide-producing sealer, such as chromic acid solutions, phosphate compound solutions, silicate solutions, and the like. Furthermore, it is also possible to use suspensions of extremely fine granules or the like. Si alkoxide alcohol (containing 15% Si), chromic acid solution (with a $Cr_2O_3$ concentration of 30%), and the like, are generally employed as the sealer.

Sealers comprising SiC system fibers onto which is sprayed or applied a coating fluid such as nikaron polymer, chirano polymer or the like, sealants in which a coating is applied to fluorine resin (PTFE) or silicon nitride system fibers, or the like, are employed as sealers of silicon compounds, boron compounds, fluorine compounds, nitrogen compounds, or carbon compounds. The concentration of the sealer should be such that the components remaining in the spray deposit comprise 10–50% in the solution or dispersion, and this must be in a state which is amenable to spraying or application.

The sealers are altered by decomposition reactions within the spray deposit to become SiC, $Si_3N_4$, and the like; however, a portion thereof solidifies and remains as a residual compound. In particular, in the case of PTFE, decomposition is controlled, and sealing may be accomplished by means of PTFE itself.

A liquid containing ultra-fine granules of BN in suspension may be applied as a boron compound system sealers. It is possible to spray or apply a fluorine resin coating having fine ceramic granules suspended therein as a fluorine resin (PTFE) system sealer. Suspensions containing fine granules of ceramics may be employed irrespective of the type of ceramic component used.

Effects of the Invention

As described above, in accordance with the present invention, a sealer is dispersed in a deposit, and simultaneously, this is baked by means of flame spraying, so that it becomes possible to form a spray deposit having a low porosity. Furthermore, if finishing sealing processing is conducted after the completion of spraying, a greater degree of perfection is possible, so that it is possible to produce a spray deposit having superior characteristics in comparison with deposits produced by conventional spraying methods.

Embodiments

The present invention will be explained in greater detail by using embodiments; however, the present invention is in no way limited to the embodiments described.

Embodiment

A test material comprising SUS304 or SM41 was attached to the surface of the roller shaped rotating cylinder shown in FIG. 1, and in addition to a sample which was treated by means of the method of the present invention, one sample was subjected to spraying only, and another sample was subjected to sealing processing after the completion of spraying. The various characteristics of the deposits which are required as the basic characteristics of spray deposits were tested according to the use thereof.

The thermal shock test is carried out in order to judge the peeling tendencies of the deposit as a result of thermal stress during repeated heating and cooling; it is an evaluative test which must be relied on in the selection of members which are subjected to thermal stress as a result of heating to high temperatures, in particular various hearth rollers used in the production of iron and steel, rollers immersed in molten zinc baths, process rollers which are subjected to mechanical shocks, boiler tubes having sprayed surfaces or the like.

Furthermore, in uses involving corrosion resistance, the degree of penetration of the solution into the deposit is a prime factor; the fineness and resistance to corrosion of a deposit is evaluated by the salt spray test. This test evaluates corrosion resistance using the degree to which rust is generated on a material as result of spraying with salt water; this is a basic evaluation method which is used with respect to a variety of uses for corrosion resistance. That is to say, by spraying acidic or alkaline solutions, or by immersion in these solutions, various plating line rollers or other members may be appropriately evaluated.

The temperatures at which the immersion rollers or the like of molten metal plating lines are employed are high, so that the most accurate method of evaluation for such rollers is the direct immersion in a bath. In order to assess the applicability to these types of uses, evaluation is conducted by carrying out a molten zinc bath immersion test.

Suga-type abrasion tests were conducted in order to evaluate various types of mechanical parts and the like such as the various process rollers of an iron and steel manufacturing line, in order to improve the resistance to abrasion thereof.

In the case of process line rollers for paper or resin films or the like, the adhesion of the paper or film to the roller can become a problem.

A spray deposit was formed by means of the method of the present invention on a refining roller or the like of a paper making process, and the effects with respect to the adhesion of water absorbing paper were evaluated by means of a test.

Figure 2:
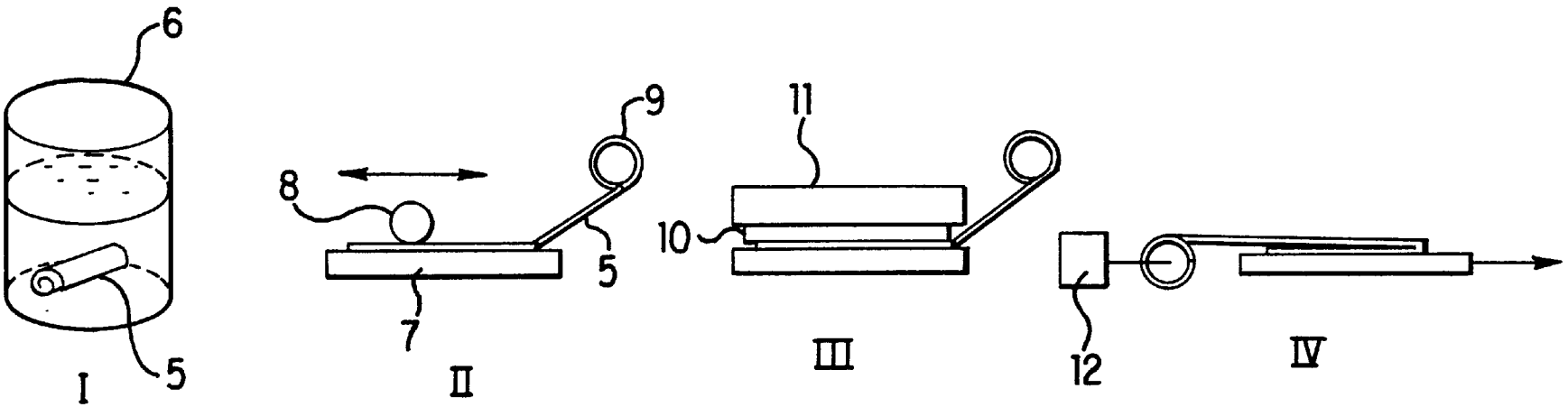
FIG. 2 is a schematic diagram of a water absorbent paper adhesion test with respect to a spray deposit.

In this test, the peeling force of adhering paper was evaluated as shown in FIG. 2. That is to say, the test paper 5 was immersed in the water 6, this was pressed onto the deposit on the spray sample 7 by roller 8, and water absorbing paper 10 and weight 11 were placed thereon, and the excess water was removed. After this, the paper was wound onto roller 9 and was pulled in the opposite direction, and the peeling force was measured by load cell 12 at this time.

In order to assess the adhesion of metals in a semi-molten state occurring, for example, in molten metal plating lines, a zinc adhesion test was conducted. This test is thought to be an essential test for the purpose of adopting sprayed rollers as process rollers in molten metal plating lines for, for example, steel plates for automobiles and the like.

Figure 3:
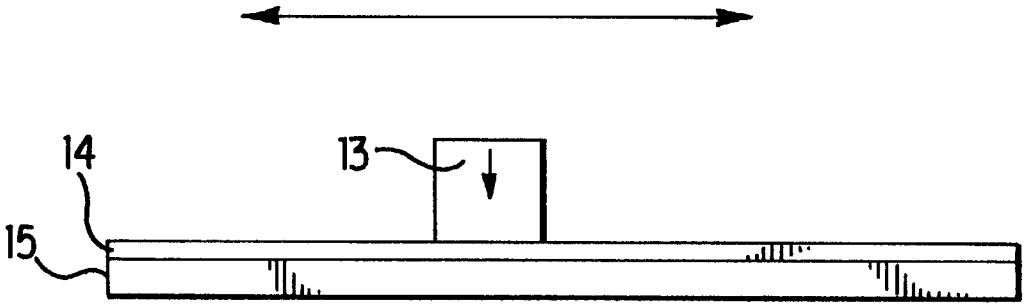
FIG. 3 is a schematic diagram of a zinc adhesion test with respect to a spray deposit.

The testing method is as shown in FIG. 3; a bar-shaped piece of zinc 13 is rubbed with a constant load against samples 14 and 15, which have been heated to the test temperature, and the amount of zinc adhering to the samples is measured.

The application of the spray deposit formed by means of the method of the present invention to a variety of uses is imagined, and testing is conducted in order to confirm that the characteristics necessary to the various fields are maintained.

Table 1 shows the conditions of the thermal shock test; the heating temperature was 700° C. and the number of cycles of heating and sudden cooling until the appearance of cracking was evaluated.

TABLE 1

Conditions of the Thermal Shock Test

| Conditions | 700° C. × 10 min. water cooling |
|---|---|
| Sample Piece Dimensions | 50 × 50 × 10t (mm) |
| Sample Piece Material | SUS 304 |
| Spray Deposit (Top Coat) | 200 μm |

The salt spray test was conducted in accordance with JIS Z 2371; the fineness and corrosion resistance of the deposit were evaluated in terms of the state of rust generation in the samples to a period of 4 weeks. In this test, in order to permit the occurrence of rust, SM41 plates were employed as the substrates.

Figure 4:
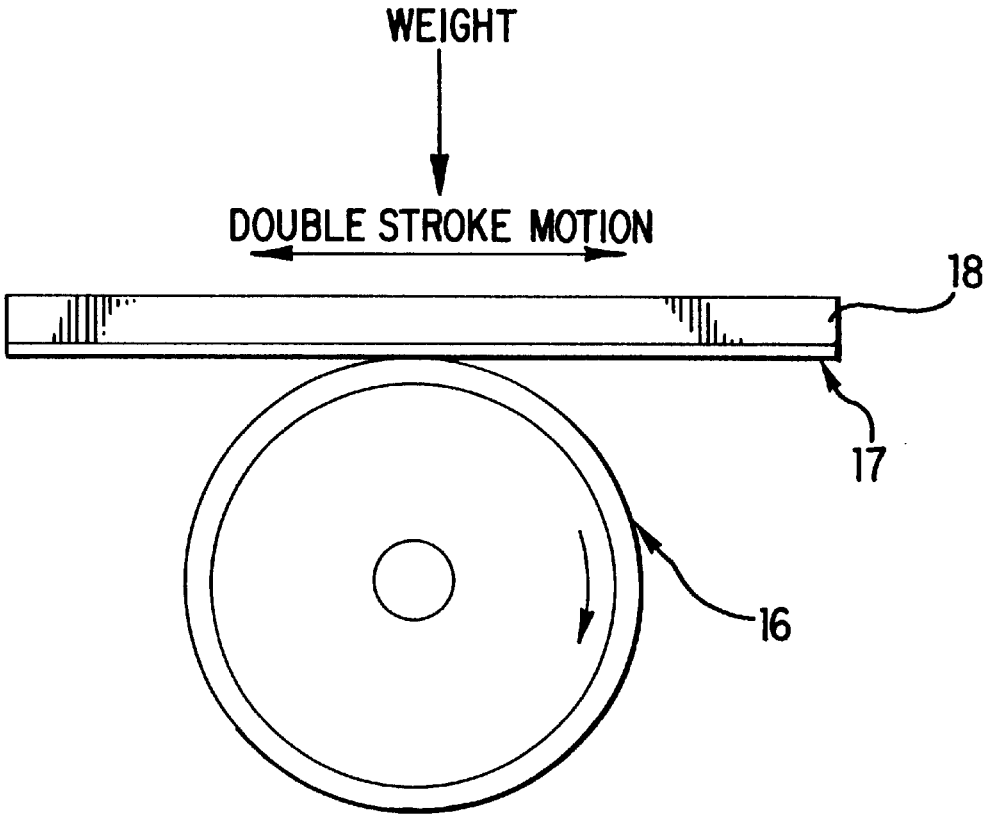
FIG. 4 is an explanatory diagram of a Suga-type abrasion test with respect to a spray deposit.

Table 2 shows the test conditions of the Suga-type abrasion test; the essentials of this test are shown in FIG. 4. A weight was placed on a sample plate 18 on which a spray deposit 17 was formed, and this was brought into contact with emery paper 16. After each double stroke cycle of the sample plate, emery paper 16 was rotated slightly so as to test a new surface. The abrasion resistance was evaluated in terms of the number of double strokes of the sample plate required to abrade 1 mg [Double Stroke (DS)/mg].

TABLE 2

Abrasion Test Conditions

| Item | Conditions |
|---|---|
| Emory paper | SiC, #320 |
| Weight (kg) | 3 |

Sample Plate Dimensions: 5t×30×50 (mm)

Substrate Material: SUS 304

Figure 5:
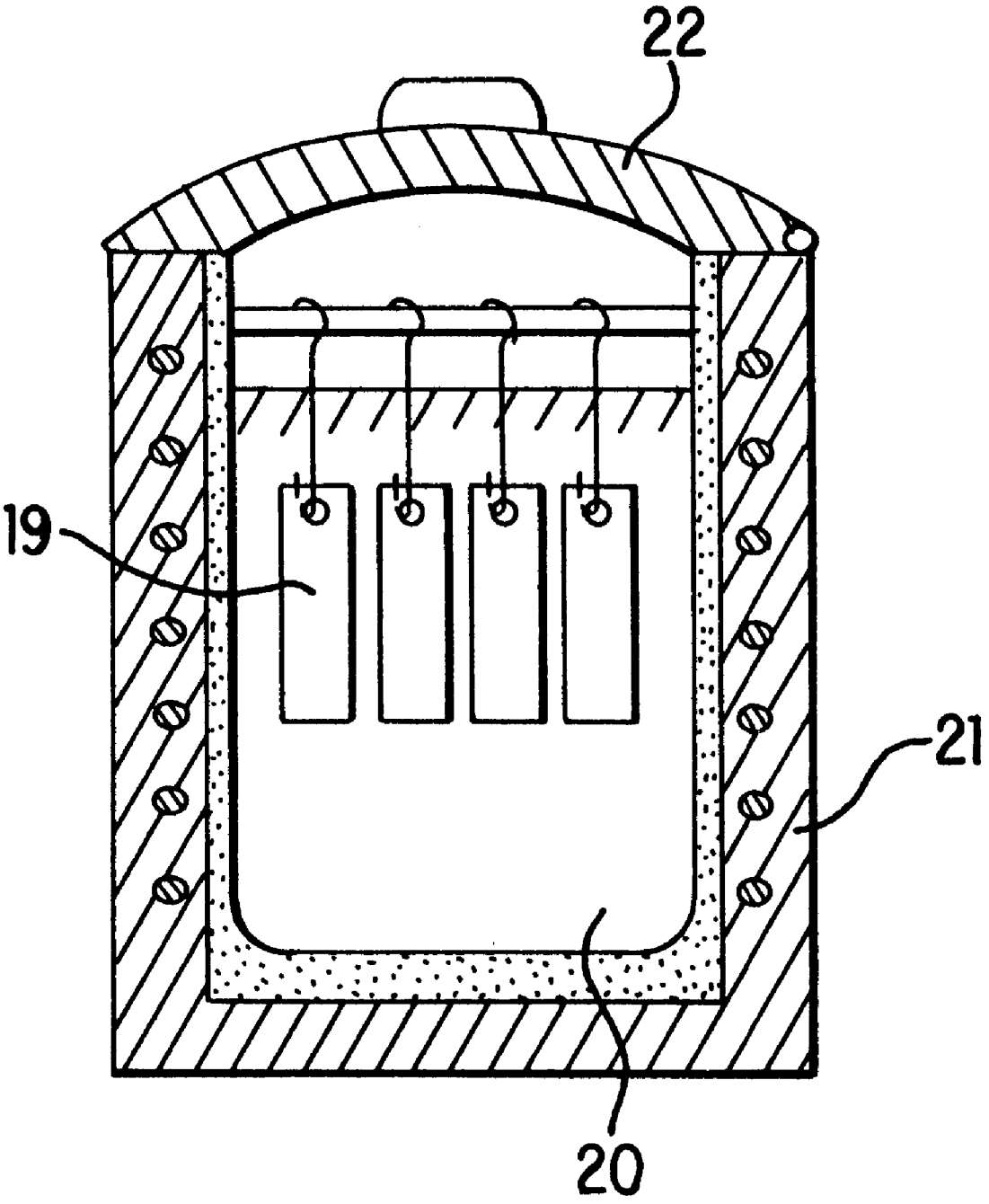
FIG. 5 is an explanatory diagram of a zinc bath immersion test with respect to a spray deposit.

Table 3 shows the test conditions of the molten zinc bath immersion test; the essentials of this test are shown in FIG. 5. Samples 19 are immersed in the molten zinc bath 20, which has been heated to the test temperature in furnace 21, and in order to prevent oxidation within the bath, lid 22 is placed thereon, and thereafter this is maintained in this state for a specified period of time, the samples are removed in order to permit inspection, acid washing is conducted with a weak acid, and an observation is carried out.

TABLE 3

Molten Zinc Bath Immersion Test Conditions

| Item | Test Conditions |
|---|---|
| Zn Bath Temperature | 500° C. |
| Bath Components | Zn - 0.3% A1 |
| Number of Days of Immersion | Inspection every 4 days |

The components of the coating material of the sample plate, the spray method, the sealer, and the like, are shown together with the results of the test. As spray materials, metal systems, oxide cermet systems, and carbide cermet systems were employed; the metal systems were chiefly used as test materials for uses requiring resistance to corrosion, while the oxide cermet systems were chiefly employed as test materials for uses requiring thermal resistance such as hearth rollers and the like, and the thermal shock resistance thereof was tested.

$Cr_3C_2$ cermet has a broad variety of uses, so that it was employed in corrosion resistance tests, abrasion resistance tests, and paper peeling tests. WC cermet was chiefly employed in tests of corrosion resistance and paper adhesion.

TABLE 4

Salt Spray Test Results

| No. | Test | Sprayed Material (Spraying Method) | Sealing Processing (Overlay spraying only) | | Salt Spray Test (Days until Occurrence of Rust) |
|---|---|---|---|---|---|
| | | | Sealing During Spraying | Sealing After Spraying | |
| 1 | Present Invention | 80% Ni - 20% Cr alloy (wire metallizing method) | Chromic Acid | — | >28 |
| 2 | " | " | " | Sol Liquid Producing $ZrO_2$, $Al_2O_3$ | >28 |
| 3 | Comparative Example | " | — | Chromic Acid | 13 |
| 4 | Present | 75% $Cr_3C_{2\ -\ 25\%}$ | Chromic | — | >28 |

TABLE 4-continued

Salt Spray Test Results

| No. | Test | Sprayed Material (Spraying Method) | Sealing Processing (Overlay spraying only) Sealing During Spraying | Sealing After Spraying | Salt Spray Test (Days until Occurrence of Rust) |
|---|---|---|---|---|---|
| | Invention | [80% Ni 20% Cr] alloy cermet (High-speed Gas Spray Method) | Acid | | |
| 5 | " | " | Nikaron Polymer Coating | — | >28 |
| 6 | " | " | Silicon Nitride-System Coating | — | >20 |
| 7 | " | WC - 12% Co Cermet (High-speed Gas Spraying Method) | Sol Produc- $SiO_2$, $Al_2O_3$ | Chromic Acid | >28 |
| 8 | " | " | SiC Suspension | — | >28 |
| 9 | Comparative Example | " | — | — | 2 |

Table 4 shows the results with respect to corrosion resistance when a salt spray test was conducted with respect to a spray deposit sample; by means of adding a sealer to the spray deposit, it can be seen that the occurrence of rust was delayed. In particular, in comparison with the cases in which the spray deposit was not subjected to sealing processing, and in which a sealer was applied to the surface only after spraying, it can be seen that the spray deposit in accordance with the method of the present invention was clearly more effective.

TABLE 5

Zn Bath Immersion Test Results

| No | Test | Spray Material (High-speed Gas Spraying Method) | Sealing Processing (Overlay Spraying Only) Sealing During Spraying | Sealing After Spraying | Zn Bath Immersion Test (Days until Occurrence of Peeling) |
|---|---|---|---|---|---|
| 1 | Present Invention | 50% WC-40% WB-10% Co Cermet | Chromic Acid | — | >20 |
| 2 | " | " | $SiO_2$ Suspension | Chromic Acid | >20 |
| 3 | Comparative Example | " | — | " | 12 |
| 4 | " | " | — | Sol Liquid Producing $SiO_2$, $Al_2O_3$ | 8 |
| 5 | " | " | — | — | 4 |

Table 5 shows an evaluation of the reactivity between molten zinc and the spray deposit of the sample as determined by the molten zinc bath immersion test. Oxide system sealers such as chromic acid systems, $SiO_2$ systems, $Al_2O_3$ systems, and the like, exhibit particularly favorable results with respect to reactivity with the molten metal.

TABLE 6

Suga-type Abrasion Test Results

| No | Test | Spraying Material (High-speed Gas Spraying Method) | Sealing Processing (overlay spraying only) Sealing During Spraying | Sealing After Spraying | Abrasion Test Results (DS/mg) |
|---|---|---|---|---|---|
| 1 | Present Invention | WC-12% Co Cermet | $Al_2O_3$ Suspension | Graphite | 400 |
| 2 | " | " | Fluorine Resin | Fluorine Resin | 430 |
| 3 | " | " | Chromic Acid Solution | — | 320 |
| 4 | Comparative Example | " | — | — | 260 |

Table 6 shows an evaluation of the test results of the spray deposits with respect to uses requiring abrasion resistance; it can be seen that the number of strokes required to abrade 1 mg from the spray deposit increases as a result of the application of the present invention, so that the wear of the hardened deposit is greatly improved. Accordingly, the present invention is effective for uses requiring abrasion resistance.

TABLE 7

Paper Peeling Test Results

| No | Test | Spraying Material (High-speed Gas Spraying Method) | Sealing Processing (Overlay Spraying Only) Sealing During Spraying | Sealing After Spraying | Paper Peeling Test Maximum Weight (g) |
|---|---|---|---|---|---|
| 1 | Present Invention | $Cr_3C_2$-25 NiCr Alloy Cermet | Fluorine Resin Solution | — | 0.18 |
| 2 | " | " | Sol Liquid Producing $SiO_2$ | Fluorine Resin Solution | 0.08 |
| 3 | " | " | SiC Suspension | Silicon Resin Solution | 0.11 |
| 4 | Comparative Example | " | — | — | 0.36 |
| 5 | " | Chrome Plating | — | — | 0.48 |

*: Cermet Composition = 75%$Cr_3C_2$-25%NiCr[80%Ni 20%Cr]

Table 7 shows an evaluation of the adhesion test results with respect to spray deposits of paper or resin-type films; it can be seen that the peeling force, that is to say, the adhesion of the water absorbent paper, is reduced when a spray deposit formed by the method of the present invention is employed. Particularly strong effects are seen when a fluorine resin system sealer, a $SiO_2$ system sealer, or a SiC system sealer is employed; it can thus be seen that a spray deposit in accordance with the method of the present invention is more appropriate for use as the deposit on a refining roller of a paper making process than the chromium plating deposit of the comparative example.

TABLE 8

Metal Adhesion Test Results (Test Temperature 300° C.)

| No | Test | Spraying Material (High-speed Gas Spray Method) | Sealing Processing (Overlay Spraying Only) Sealing During Spraying | Sealing After Spraying | Stroke Count to Zn Adhesion (Cycles) |
|---|---|---|---|---|---|
| 1 | Present Invention | WC-12% Co Cermet | Sol Liquid Producing $ZrO_2$ | — | 120 |
| 2 | " | " | Sol Liquid Producing $CeO_2$ | Graphite System | >200 |
| 3 | " | " | Sol Liquid Producing $SiO_2$, $Al_2O_3$ | — | 150 |
| 4 | Comparative Example | " | — | — | 40 |

Table 8 shows an evaluation with respect to metallic adhesion at high temperatures; extremely striking effects are seen when the method of the present invention is applied for use in $SiO_2$ system sealers and $ZrO_2$ system sealers, and it can be seen that the spray deposit in accordance with the method of the present invention exhibits favorable characteristics.

TABLE 9

Thermal Shock Test Results

| No | Test | Spraying Material (Spraying (Method) | Sealing Processing (Overlay Spraying Only) Sealing During Spraying | Sealing After Spraying | Cycles to Occurrence of Peeling (cycles) |
|---|---|---|---|---|---|
| 1 | Present Invention | COCrAlY (bottom layer 5$\mu$m) - YSZ Cermet (Plasma Spraying Method) | Sol Liquid Producing $Al_2O_3$ | — | >25 |
| 2 | " | " | Chromic Acid Solution | — | >25 |
| 3 | Comparative Example | " | — | — | >20 |
| 4 | Present Invention | WC-12% Co Cermet Speed Gas Spraying Method) | $Al_2O_3$ Suspension | — | >30 |
| 5 | " | " | Sol Liquid producing $Al_2O_3$ | — | >30 |
| 6 | " | " | Chromic Acid Solution | — | >30 |
| 7 | Comparative Example | " | — | — | >25 |

*Cermet Composition COCrAlY = 63%Co-23%Cr-13%Al-1%Y,YSZ = 92%$ZrO_2$-8%$Y_2O_3$

An evaluation of the thermal resistance and resistance to peeling is shown in Table 9; as a result of employing $Al_2O_3$ system sealers or chromic acid system sealers, the resistance to thermal shock is improved.

Industrial Applicability

As described above, the technology of the present invention, which involves simultaneous spraying and sealing to form a deposit, is particularly applicable as a method of forming spray deposits applied to mechanical parts in a wide variety of industrial fields; the industrial value of such a value is very large.

We claim:

1. A method of forming a spray deposit, comprising:

applying a spray deposit on a target object, wherein the application of the spray deposit is conducted by a method selected from the group consisting of flame spraying, plasma spraying and wire metallizing, and applying a sealer onto the spray deposit formed on the target object immediately after the spray deposit has been applied on the target object so that a layer of sealer components contained in the sealer is formed immediately on the spray deposit while a liquid component of the sealer volatilizes as a result of the retained heat of the spray deposit from the application of the spray deposit.

2. A method of forming a spray deposit according to claim 1, wherein while the spray deposit and the sealer are being applied onto the target object, the target object is being rotated so that the spray deposit and the sealer are formed on the target object substantially at a same time.

3. A method of forming a spray deposit according to claim 1, wherein after the layer of the sealer components is formed on the spray deposit, a succeeding spray deposit is formed on the thin layer.

4. A method of forming a spray deposit according to claim 1, wherein the spray deposit contains a spray material selected from a group consisting of metal, cermet and ceramics.

5. A method of forming a spray deposit according to claim 1, wherein the sealer comprises a material forming an oxide selected from a group consisting of $Cr_2O_3$, $Al_2O_3$, $SiO_2$ and $ZrO_2$.

6. A method of forming a spray deposit according to claim 1, wherein said sealer contains at least one material selected from a group consisting of silicon compounds, boron compounds, fluorine compounds, nitrogen compounds and carbon compounds so that the layer of sealer contains at least one material selected from a group consisting of silicides, borides, fluorides, nitrides and carbides.

7. A method of forming a spray deposit according to claim 1, further comprising forming a substrate layer on the target object before the spray deposit is applied, said substrate layer being formed by applying a spray deposit on the target object.

8. A method of forming a spray deposit according to claim 1, further comprising providing a heat treatment onto the target object with the spray deposit and the layer, to improve a binding force of components of the spray deposit.

9. A method of forming a spray deposit according to claim 1, further comprising providing a further finishing sealing processing after formation of the spray deposit and application of the layer of sealer.

* * * * *